US007302715B1

(12) United States Patent
Finell

(10) Patent No.: US 7,302,715 B1
(45) Date of Patent: Dec. 4, 2007

(54) BATH ACCESSORY HOLDER AND SCOOP

(76) Inventor: Rebecca M. Finell, 436 W. Bolero Dr., Tempe, AZ (US) 85284

( * ) Notice: Subject to any disclaimer, the term of this patent is extended or adjusted under 35 U.S.C. 154(b) by 303 days.

(21) Appl. No.: 10/899,616

(22) Filed: Jul. 27, 2004

(51) Int. Cl.
*A47K 3/00* (2006.01)

(52) U.S. Cl. ..... 4/559; 446/73

(58) Field of Classification Search ..... 4/559, 4/628, 638, 654, 656, 661; 211/119.009, 211/119.011, 77.01; 206/77.1, 223, 370; 248/206.2, 206.3, 205.5; 446/72, 73; 220/481, 220/736

See application file for complete search history.

(56) References Cited

U.S. PATENT DOCUMENTS 3,063,190 A * 11/1962 Adelson ..... 206/77.1
5,673,884 A * 10/1997 Yemini ..... 248/205.5
5,702,003 A * 12/1997 Springer ..... 206/457
6,431,386 B1 * 8/2002 Hofman et al. ..... 220/481
6,663,458 B1 12/2003 Jauregui

* cited by examiner

*Primary Examiner*—Huyen Le
(74) *Attorney, Agent, or Firm*—Parsons & Goltry; Michael W. Goltry; Robert A. Parsons

(57) ABSTRACT

A bath accessory collection, holder, and storage device includes a base, and a scoop, removably couplable to the base, having a drain for draining liquid therefrom. A handle is attached to the scoop, which is used to wield the scoop. A hanger is carried by one of the base and the scoop, which is used to suspend at least one bath accessory thereon. In another embodiment, there is a clamp carried by one of the base and the scoop, which is capable of grippingly holding at least one bath accessory. The base is furnished with a shelf for receiving and supporting bath accessories thereon. An engagement element is carried by one of the base and the scoop, and a detachably engagable complemental engagement element carried by the other of the base and the scoop. Preferably, the device presents the appearance of an object or thing designed to promote interest in the device by children and for encouraging use of the device when the scoop is attached to the base.

22 Claims, 8 Drawing Sheets

FIGURE
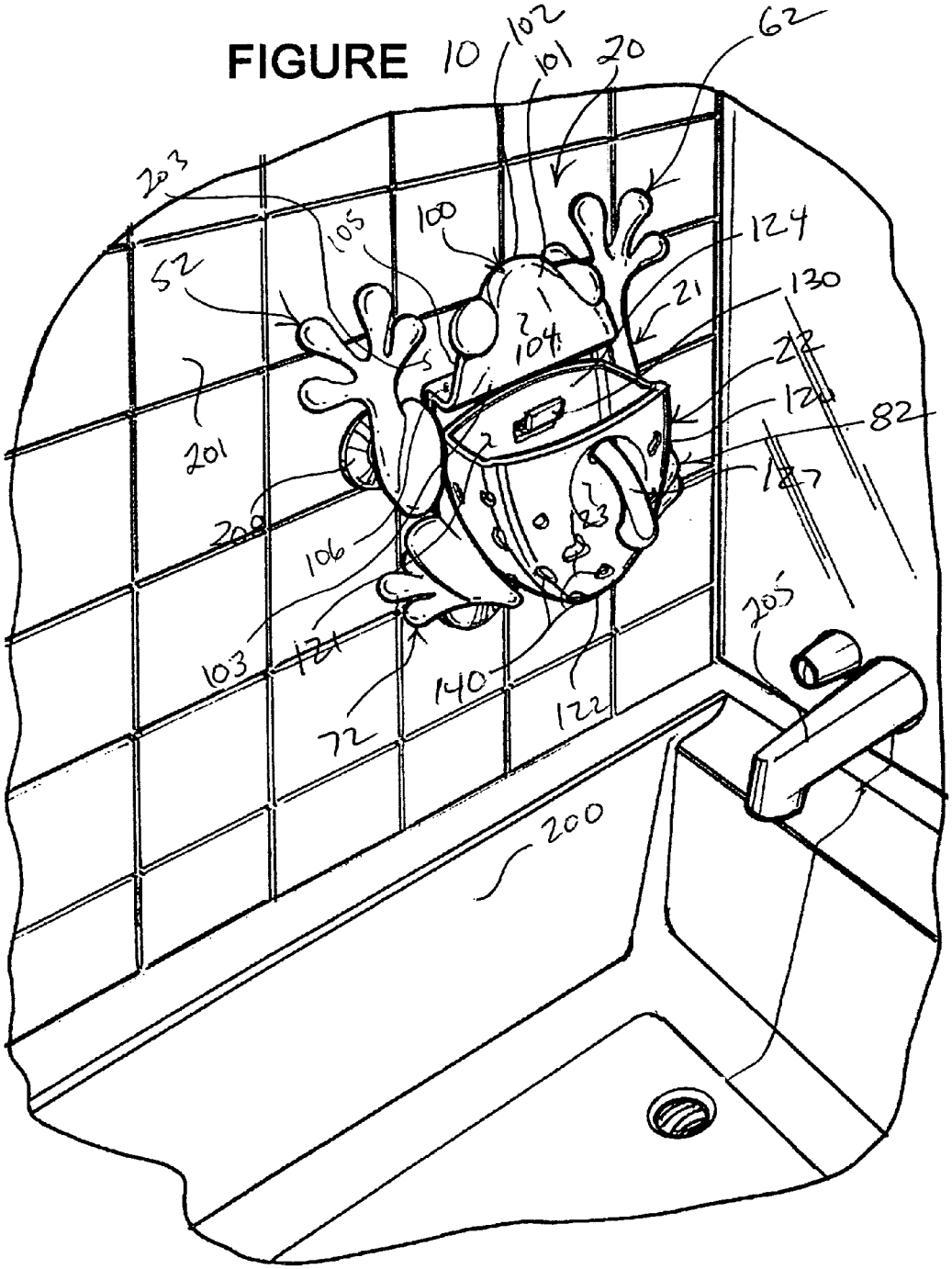

BATH ACCESSORY HOLDER AND SCOOP

FIELD OF THE INVENTION

The present invention relates to bath accessories, and, more particularly, to specialized devices for holding and storing bath accessories.

BACKGROUND OF THE INVENTION

In an effort to make bathing a fun, enjoyable experience, many parents provide their children with bath toys for the children to play with during bath time. The problem with bath toys is that they are often left in the bottom of a tub following use of the tub. This is a problem, because the moist environment at the bottom of the tub on and around the bath toys promotes the buildup of mold and bacteria on the bath toys. The proliferation of mold and bacteria on bath toys poses serious health concerns for young children. In fact, it is recommended that bath toys be properly rinsed and stored after use so that they will readily dry to prevent the buildup of mold and bacteria. However, rinsing and storing bath toys is very inconvenient. Each toy must be picked up and rinsed separately, and then placed on a rack or shelf for drying. Because collecting, rinsing, and properly storing bath toys is so inconvenient, and because there is nothing in the prior art for use in doing so, many people fail to do so and just leave the bath toys in the bottom of the tub so as to be prone to mold and bacteria build up.

Given these and other deficiencies in the art, there is a need in the art for easy and efficient way to collect, rinse, and store bath toys, and, moreover, for holding and storing bath toys and other bath accessories, including, for instance, bath poufs, wash cloths, soap, shampoo, conditioner, and other accessories commonly used for bathing.

SUMMARY OF THE INVENTION

The above problems and others are at least partially solved and the above objects and others realized in a bath accessory holder and storage device, which consists of a base, and a scoop, removably couplable to the base, having a drain for draining liquid therefrom. In a particular embodiment, the drain includes at least one opening through the scoop. In another embodiment, the drain includes a plurality of openings through the scoop. A handle is attached to the scoop, which is used to wield the scoop. A hanger is carried by one of the base and the scoop, which is used to suspend at least one bath accessory thereon. A clamp is also carried by one of the base and the scoop, which is for grippingly holding at least one bath accessory. A shelf for receiving and supporting bath accessories thereon is carried by the base. An engagement element carried by one of the base and the scoop, and a detachably engagable complemental engagement element carried by the other of the base and the scoop. Preferably, the engagement element is one of a scoop hanger and an abutment, and the complemental engagement feature is the other of the scoop hanger and the abutment. The base is capable of being secured to a surface, such as the surface of a wall, for convenient placement. In a preferred embodiment, the mechanism for detachably securing the device a surface is at least one suction cup. Those having regard for the art will appreciate that other ways of coupling the base to a surface can be used without departing from the invention, such as one or more hook and loop fasteners, hangers, hooks, snap fasteners, screws, etc. Preferably, the device presents the appearance of an object or thing designed to promote interest in the device by children and for encouraging use of the device when the scoop is attached to the base.

Another embodiment of a bath accessory holder and storage includes a base, a scoop, removably couplable to the base, having a drain for draining liquid therefrom, and appendages carried by at least one of the base and the scoop, in which the device presents the appearance of an animal having appendages when the scoop is attached to the base. In a particular embodiment, the drain includes at least one opening through the scoop. In another embodiment, the drain includes a plurality of openings through the scoop. A handle is attached to the scoop, which is used to wield the scoop. A hanger is carried by one of the appendages, which is used to suspend at least one bath accessory thereon. In another embodiment, a clamp is carried by one of the appendages, which is for grippingly holding at least one bath accessory. A shelf for receiving and supporting bath accessories thereon is carried by the base. An engagement element carried by one of the base and the scoop, and a detachably engagable complemental engagement element carried by the other of the base and the scoop. Preferably, the engagement element is one of a scoop hanger and an abutment, and the complemental engagement feature is the other of the scoop hanger and the abutment. The base is capable of being secured to a surface, such as the surface of a wall, for convenient placement. In a preferred embodiment, the mechanism for detachably securing the device a surface is at least one suction cup. Those having regard for the art will appreciate that other ways of coupling the base to a surface can be used without departing from the invention, such as one or more hook and loop fasteners, hangers, hooks, snap fasteners, screws, etc.

Yet another embodiment of a bath accessory holder and storage device includes a base having appendages and a head. The head has a shelf for receiving and supporting bath accessories thereon. A scoop, which is removably couplable to the base, has a drain for draining liquid therefrom. The appendages, the head, and the scoop present the appearance of an animal when the scoop is attached to the base. In a particular embodiment, the drain includes at least one opening through the scoop. In another embodiment, the drain includes a plurality of openings through the scoop. A handle is attached to the scoop, which is used to wield the scoop. A hanger is carried by one of the appendages, which is used to suspend at least one bath accessory thereon. In another embodiment, a clamp is carried by one of the appendages, which is for grippingly holding at least one bath accessory. A shelf for receiving and supporting bath accessories thereon is carried by the base. An engagement element carried by one of the base and the scoop, and a detachably engagable complemental engagement element carried by the other of the base and the scoop. Preferably, the engagement element is one of a scoop hanger and an abutment, and the complemental engagement feature is the other of the scoop hanger and the abutment. The base is capable of being secured to a surface, such as the surface of a wall, for convenient placement. In a preferred embodiment, the mechanism for detachably securing the device a surface is at least one suction cup. Those having regard for the art will appreciate that other ways of coupling the base to a surface can be used without departing from the invention, such as one or more hook and loop fasteners, hangers, hooks, snap fasteners, screws, etc.

Yet still another embodiment of a bath accessory holder and storage device includes a base having appendages, a head, having a shelf for receiving and supporting bath accessories, removably couplable to the base, and a scoop, removably couplable to the base, having a drain for draining liquid therefrom, wherein the appendages, the head, and the scoop present the appearance of an animal when the scoop and the head are attached to the base. In a particular embodiment, the drain includes at least one opening through the scoop. In another embodiment, the drain includes a plurality of openings through the scoop. A handle is attached to the scoop, which is used to wield the scoop. A hanger is carried by one of the appendages, which is used to suspend at least one bath accessory thereon. In another embodiment, a clamp is carried by one of the appendages, which is for grippingly holding at least one bath accessory. A shelf for receiving and supporting bath accessories thereon is carried by the base. An engagement element carried by one of the base and the scoop, and a detachably engagable complemental engagement element carried by the other of the base and the scoop. Preferably, the engagement element is one of a scoop hanger and an abutment, and the complemental engagement feature is the other of the scoop hanger and the abutment. The base is capable of being secured to a surface, such as the surface of a wall, for convenient placement. In a preferred embodiment, the mechanism for detachably securing the device a surface is at least one suction cup. Those having regard for the art will appreciate that other ways of coupling the base to a surface can be used without departing from the invention, such as one or more hook and loop fasteners, hangers, hooks, snap fasteners, screws, etc.

Consistent with the foregoing summary of preferred embodiments, and the ensuing disclosure, which are to be taken together, the invention also contemplates associated apparatus and method embodiments including, but not limited to, methods of collecting and storing bath accessories.

BRIEF DESCRIPTION OF THE DRAWINGS

Referring to the drawings:

FIG. 10 is an isometric view of the device of FIG. 1 shown as it would appear attached to a wall adjacent a bathtub;

DETAILED DESCRIPTION OF A PREFERRED EMBODIMENT

A bath accessory collection, holder, and storage device will now be described with reference to FIGS. 1-13.

Figure 1:
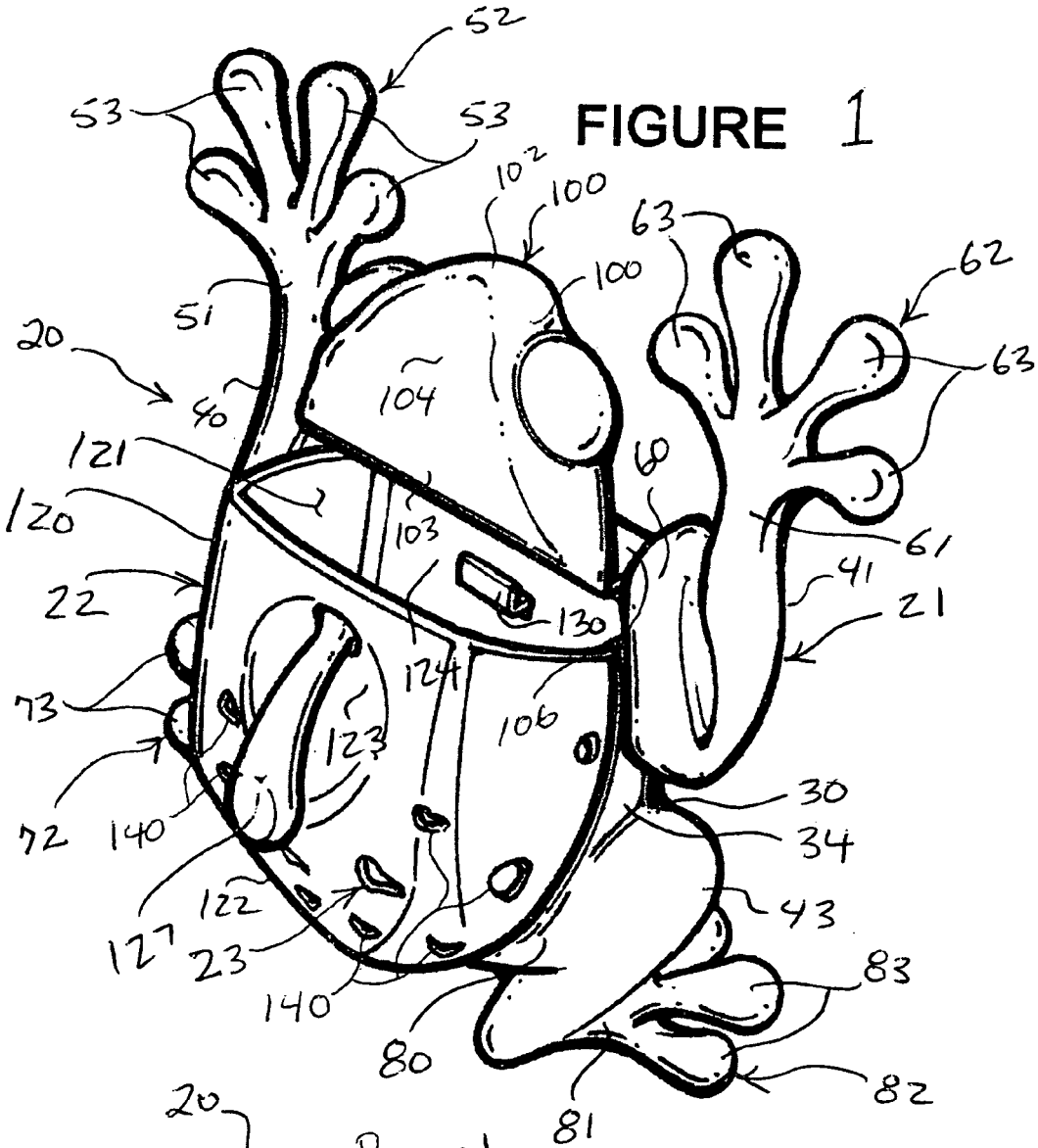
FIG. 1 is an isometric view of a bath accessory collection, holder, and storage device, constructed and arranged in accordance with the principle of the invention, the device including a base and a scoop removably attached to the base.

Turning now to the drawings, in which like reference characters indicate corresponding elements throughout the several views, attention is first directed to FIG. 1 in which there is seen a bath accessory collection, holder, and storage device, embodying the principle of the instant invention, generally indicated by the reference character 20 including a base 21, and a scoop 22, removably attached to base 21. Base 21 is essentially a caddy that can be used to hold and support soap, shampoo, conditioner, wash cloths, bath poufs, and other selected bath accessories, and scoop 22 is useful for collecting bath accessories, such as bath toys and the like, from the bottom of a tub or shower, and also storing scooped-up bath accessories by reattaching scoop 22 to base 21. Scoop 22 incorporates a drain, designated generally at 23, for draining/drawing liquid, such as bath water and rinse water, from scoop 22, and, moreover, from bath accessories placed into scoop 22. Again, device 20 is useful for, collecting, holding, and storing bath accessories, such as bar soap, bottles of body wash, shampoo, conditioner, and the like, wash clothes, bath poufs, bath toys, and other selected bath accessories, and this will be more fully discussed later in this specification.

Figure 12:
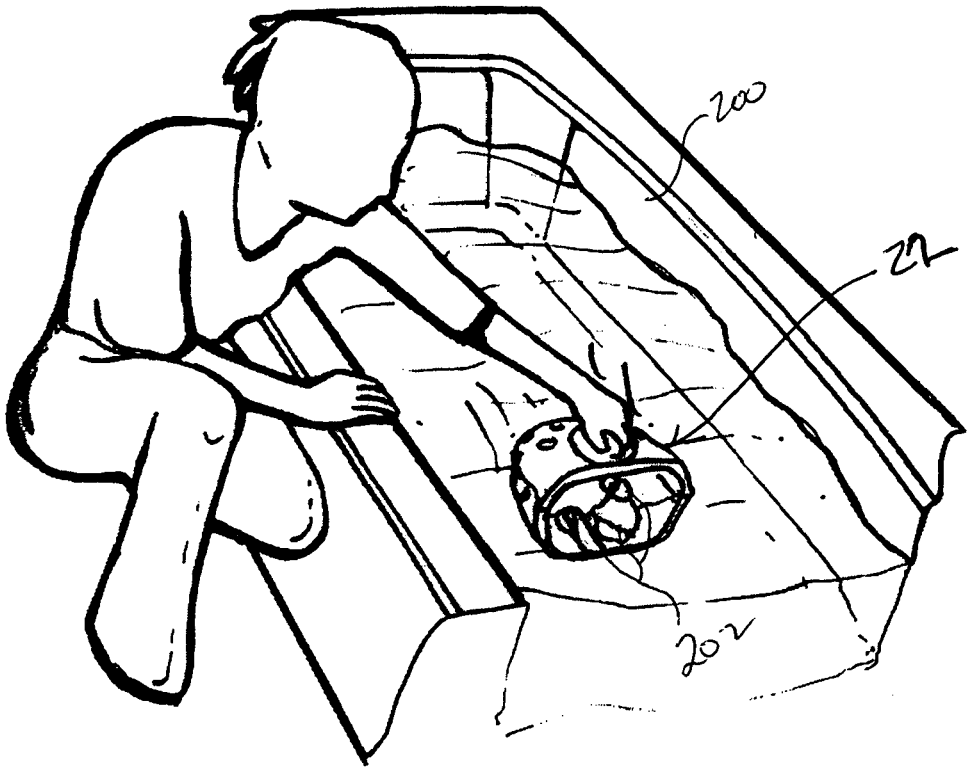
FIGS. 12 and 13 show the scoop of FIG. 1 as it would appear detached from the base and in use.
Figure 13:
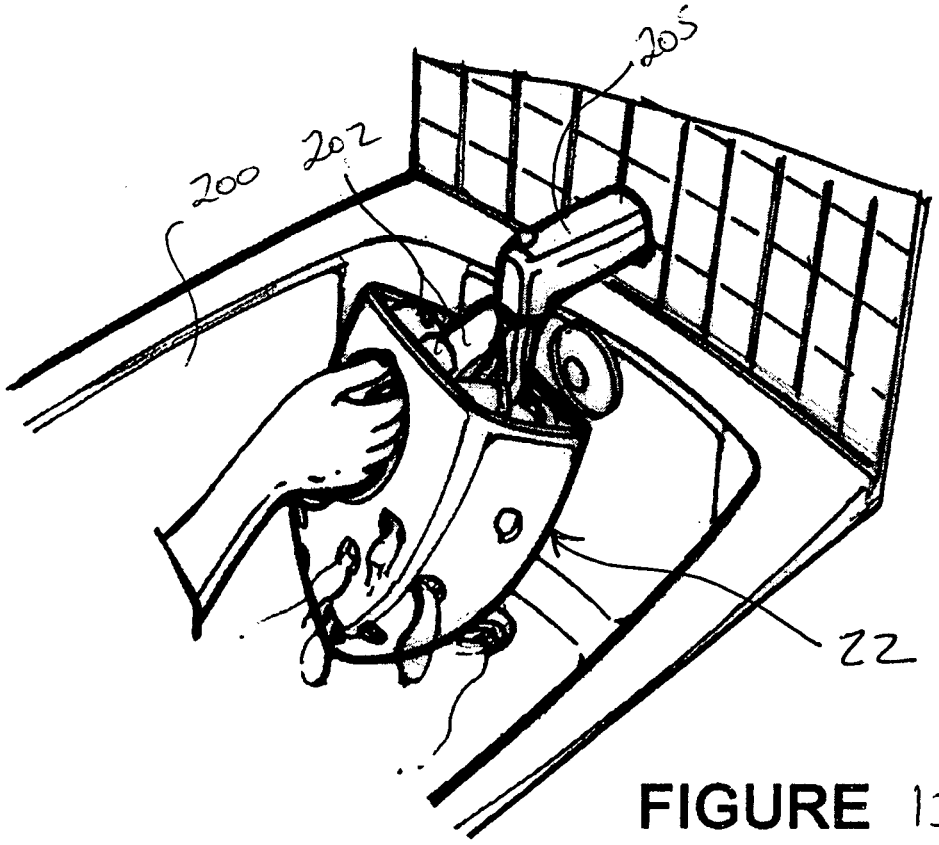

To collect and store bath accessories with device 20, for example, scoop 22 is taken up by hand and detached from base, and used to scoop bath toys and other bath accessories from a tub 15 as seen in FIG. 12, shower or other bathing area. Drain 23 permits water to drain from scoop 22 and away from the bath accessories contained therein. After scooping up bath accessories, scoop 22 can then be reattached to base 21, providing convenient storage of the bath accessories contained therein. Prior to reattaching scoop 22 to base 21, clean water can be poured into scoop 22 over the bath accessories contained therein, as shown in FIG. 13, for rinsing the bath accessories scooped up therein, in which drain 23 functions to drain the rinse water from scoop 22 and away from the bath accessories allowing them to dry. Device 20 is normally mounted near or adjacent a tub or a shower for convenient access.

Figure 2:
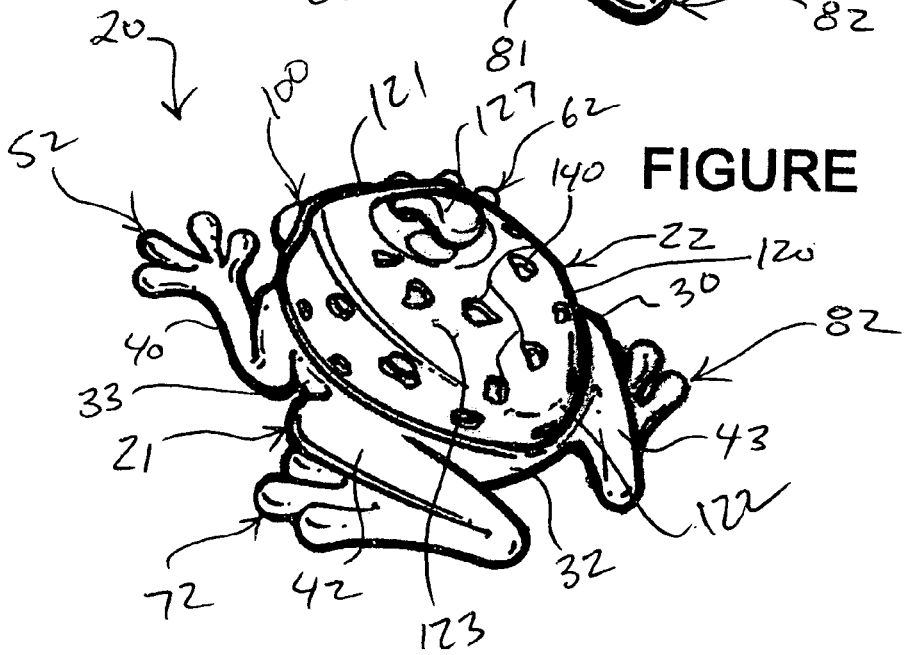
FIG. 2 is a rearward isometric view of the device of FIG. 1.
Figures 3, 4, 6:
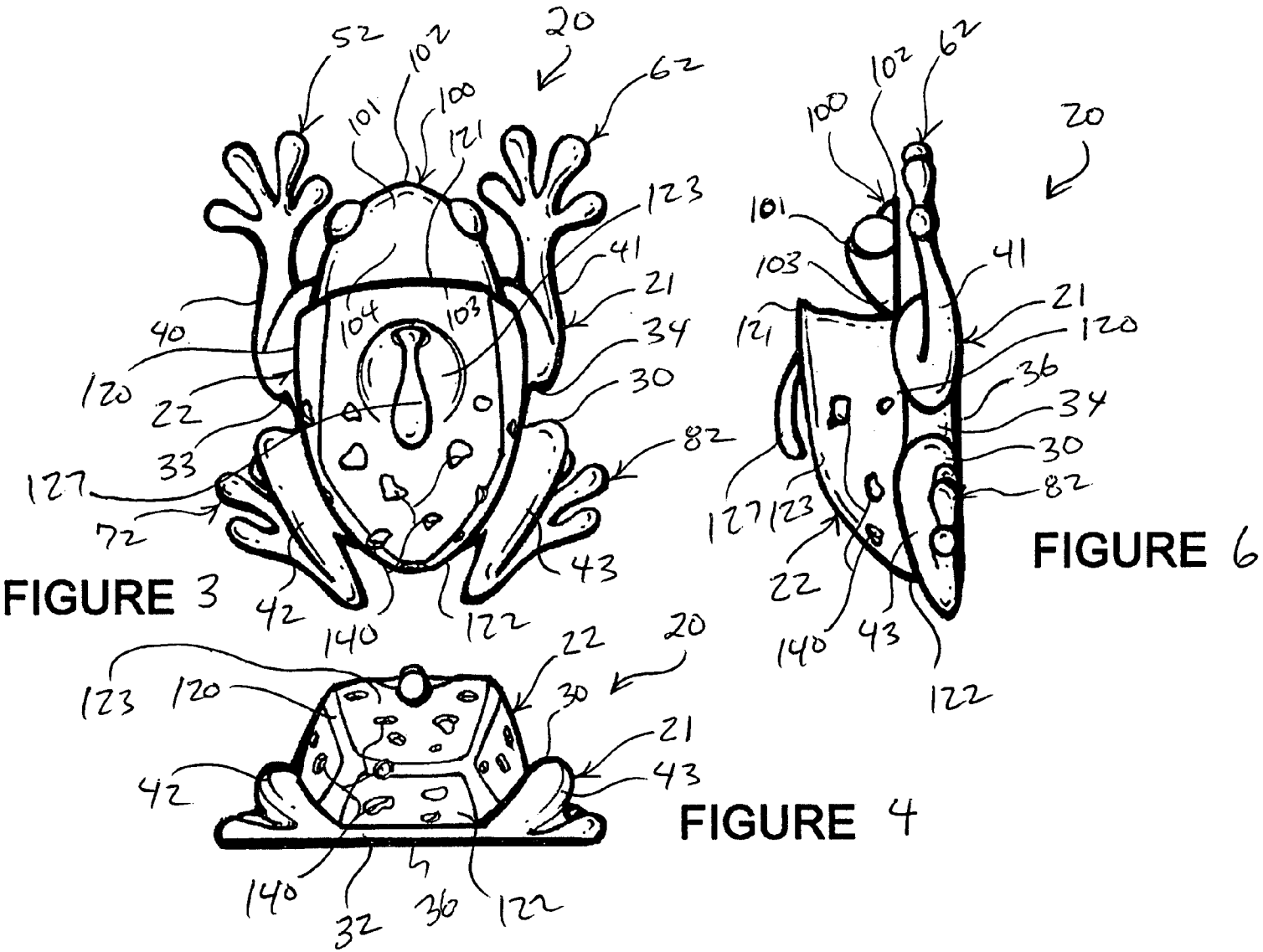
FIG. 3 is a front plan view of the device of FIG. 1.
FIG. 4 is a rear end elevational view of the device of FIG. 1.
FIG. 6 is a right side elevational view of the device of FIG. 1, the opposing left side elevational view being a substantial mirror image thereof.
Figure 5:
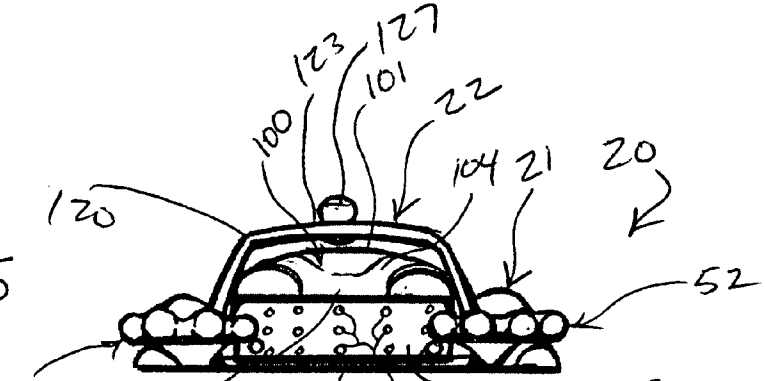
FIG. 5 is a front end elevational view of the device of FIG. 1.

As a matter of disclosure, FIG. 2 is a rearward isometric view of device 20, FIG. 3 is a front plan view of device 20, FIG. 4 is a rear end elevational view of device 20, FIG. 5 is a front end elevational view of device 20, and FIG. 6 is a right side elevational view of device 20, the opposing left side elevational view being a substantial mirror image thereof.

Figure 8:
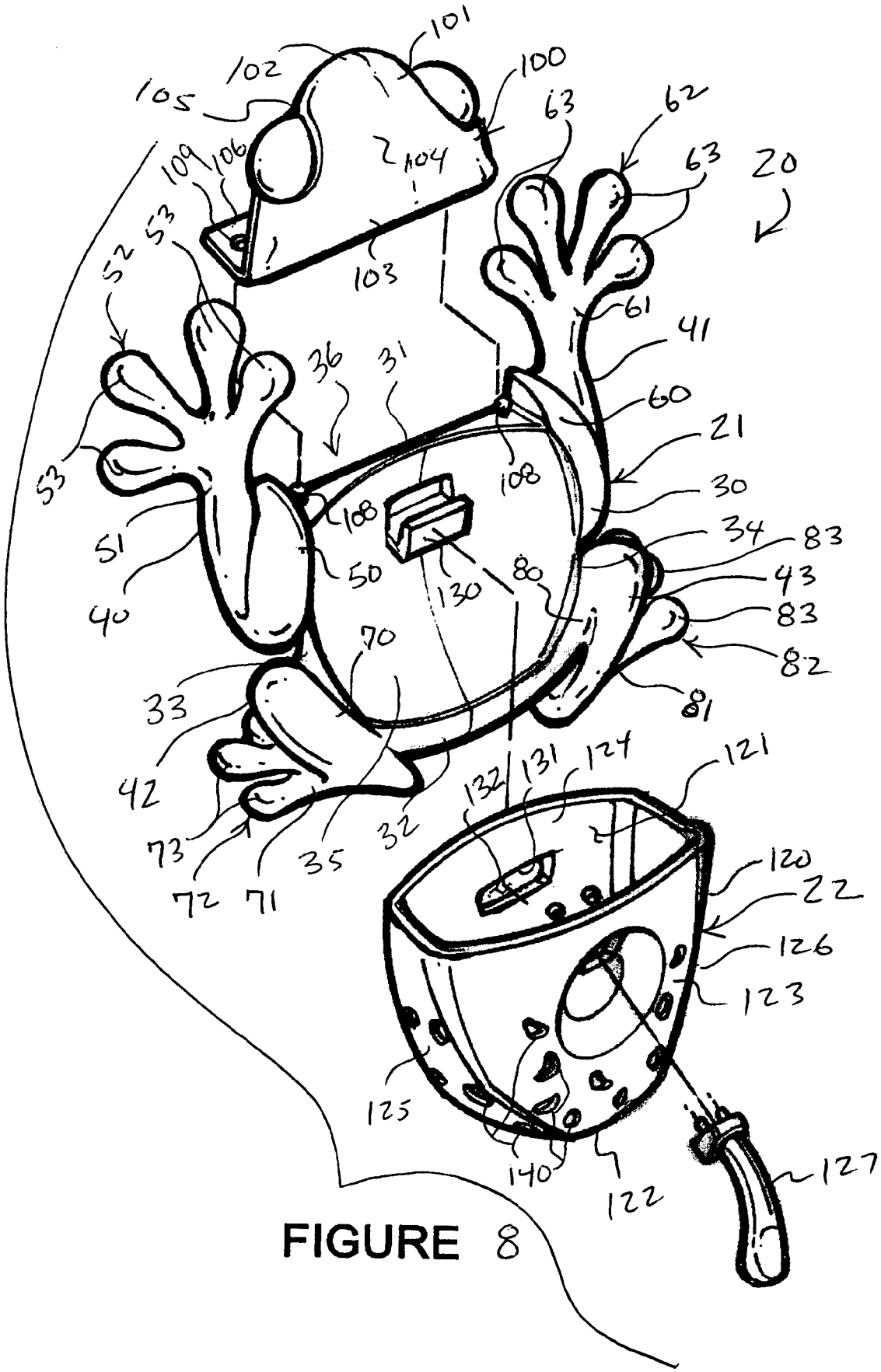
FIG. 8 is an exploded isometric view of the device of FIG. 1.

Referring to FIG. 8, base 21 consists of a body 30 having an upper extremity 31, a lower extremity 32, opposing side extremities 33 and 34, a front face 35, and an opposing back face 36, which is also denoted in FIGS. 4-6, 9, and 11. Attached to body 30 is a pair of opposing upper appendages 40 and 41, located generally at upper extremity 31, and a pair of opposing lower appendages 42 and 43, located generally at lower extremity 32. Body 30 is fashioned of plastic, wood, metal, or other selected material or combination of materials, and is either integrally formed or fashioned as an assembly of two or more attached parts, and even two or more removably attached parts, if desired. Considering the latter, for instance, appendages 40-43 can be removably attached with ball and socket attachment features, tongue and groove attachment features, complementing male and female threaded attachment features, etc. Preferably, body 30 is integrally fashioned of plastic or other similar material or combination of materials resistant to corrosion or deterioration as a result of prolonged exposure to moisture.

Appendage 40 has a proximal end 50 attached to side extremity 32, and projects outwardly therefrom away from side extremity 32 of body 30 and terminates with a distal end 51, which is a hand 52 having a plurality of spaced-apart pegs or fingers 53. Appendage 41 is basically a substantial mirror image of appendage 40. Like appendage 40, appendage 41 has a proximal end 60 attached to side extremity 33, and projects outwardly therefrom away from side extremity 33 of body 30 and terminates with a distal extremity 61, which is a hand 61A having a plurality of spaced-apart pegs or fingers 61B. Appendage 42 has a proximal end 70 attached to side extremity 32, and projects outwardly therefrom away from side extremity 32 of body 30 and terminates with a distal extremity 71, which is a foot 71A having a plurality of spaced-apart pegs or toes 71B. Appendage 43 is basically a substantial mirror image of appendage 42. Like appendage 42, appendage 43 has a proximal end 80 attached to side extremity 33, and projects outwardly therefrom away from side extremity 33 of body 30 and terminates with a distal extremity 81, which is a foot 81A having a plurality of spaced-apart pegs or toes 81B.

Figure 9:
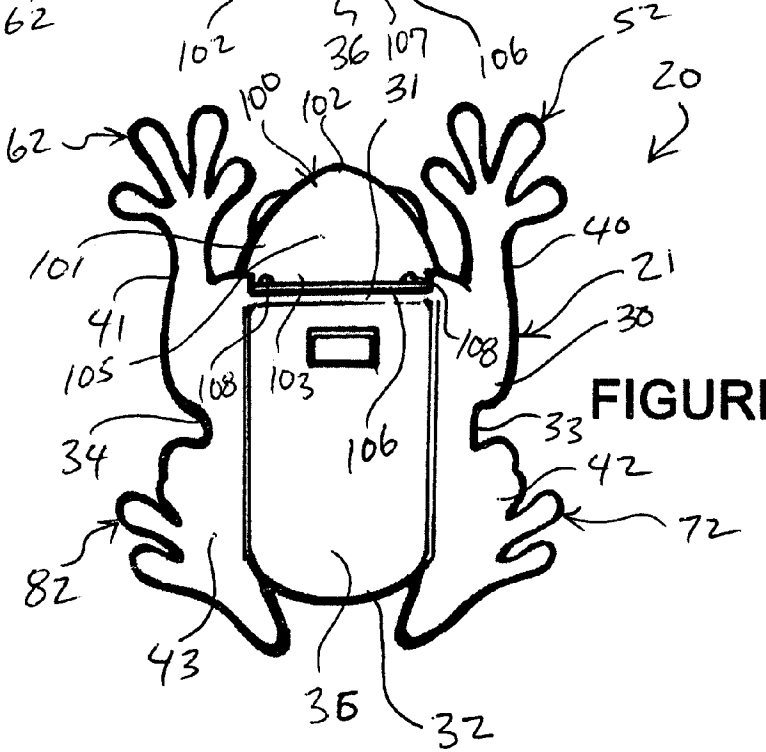
FIG. 9 is a back plan view of the base of FIG. 1.

Looking to FIGS. 1, 3, 7, and 9, body 30 also incorporates a headset 100, which is removably attached to body 30 and positioned between arms 40 and 41 and projects upwardly from upper extremity 31 (upper extremity referenced only in FIGS. 8 and 9). Headset 100 is centrally located along the central vertical axis of device 10 and, as seen in FIG. 8, consists of an upstanding head 101 having an upper end 102 and an opposing lower end 103, a front face 104 and an opposing back face 105, and a generally horizontal shelf 106, which is attached to lower end 101B and projects rearwardly of back face 105. Headset 100 is fashioned of the same material or combination of materials as body 30, and is either integrally formed or fashioned as an assembly of two or more attached parts. As seen in FIG. 5, a plurality of drainage holes 107 is formed through shelf 104.

Headset 100 is a separate unit, which, in the preferred embodiment disclosed herein, is removably couplable to upper extremity 31 of body 30 so that it may be selectively attached and detached as may be desired, such as for cleaning purposes, storage purposes, etc. Properly attached to body 30 as seen in FIGS. 1, 9, and 10, head 101 projects upwardly from upper extremity 31 between appendages 40 and 41, front face 104 faces forwardly as with front face 35 of body, back face 105 faces rearwardly as with back face 36 of body 30, and shelf 107 projects rearwardly of back face 105. In the preferred embodiment disclosed herein, headset 100 is removably couplable to upper extremity 31 of body 30 with a pair of opposing headed pins 108 attached to upper extremity 31 of body 30 that are accepted by a corresponding pair of engagement openings 109 (only one shown) through shelf 106. Pins 108 and corresponding engagement openings 109 represent a preferred engagement structure for facilitating a detachably engagement of headset 100 to body 30. Although pins 108 are carried by body 30 and engagement openings 109 are carried by shelf 106, this arrangement can be reversed, if desired, or mixed and match, as desired. Although two pins 108 and two corresponding engagement openings 109 are disclosed in a preferred embodiment of an engagement structure for detachably engaging headset 100 to body 30, less or more can be used. Moreover, those having regard for the art will readily appreciate that other ways of removably or detachably engaging or coupling headset 100 to body 30 can be used without departing from the invention, such as various forms of complementing male and female engagement features, a tongue and groove assembly, mutual snap fasteners, screws, a hook and loop fastener, etc. When attached to body 30, headset 100 can be considered part of body 30. Furthermore, headset 100 is considered part of base 21.

In an alternate embodiment, headset 100 can be permanently attached to body 30, such as with welding or by forming headset 100 integrally with body 30. Although headset 100 incorporates a single shelf, it can be furnished with more, if desired. One or more shelves can also be incorporated with base 21 at other locations, if desired, for increasing the storage capacity of base 21.

Having described the structural features of base 21, scoop 22 will now be discussed in detail. As its name suggests, scoop 22 is just that, namely, a bucket-like utensil for scooping up objects, such as bath accessories. Scoop 22 consists of a continuous sidewall 120 having an open upper end 121, and an opposing lower end 122. Continuous sidewall 120 is the main structure of scoop 22, and has a front end 123 and an opposing rear end 124, and opposing sides 125 and 126. Scoop 22 is fashioned of the same material or combination of materials as body 30, and is either integrally formed or fashioned as an assembly of two or more attached parts. A handle 127 is attached to continuous sidewall 120 at front end 123, and projects outwardly therefrom and away from the interior of scoop 22. Handle 127 is capable of being taken up by hand and used to wield scoop 22. Although handle 127 is attached to scoop 22 at front end 123, it can be attached to scoop 22 at other locations for allowing it to be taken up by hand and used to wield scoop 22. Handle 127 can be attached to scoop 22 with one or more screws, nut and bolt assemblies, hook and loop fasteners, pins, welding, or by way of any other suitable attachment mechanism. Handle 127 can also be integrally formed with scoop 22, if desired, and can take on any shape or form. For enhanced gripping characteristics, handle 127 can be furnished with an exteriorly attached elastomeric sleeve, sock, patch, or the like. Although incorporating a handle with scoop 22 is desirable, it can be furnished without one, if desired.

Scoop 22 is removably couplable to body 30 and, thus, to base 21, so that it may be easily and repeatedly secured to body 30 and detached from body 30 for allowing it to be used to collect and store bath accessories from the bottom of a tub or shower. Rear end 124 of scoop 22 is positionable against front face 35 so as to place scoop 22 just below headset 100 between sides 33 and 34 of body 30, with open upper end 121 of scoop 22 directed upwardly toward headset 100 and appendages 40 and 41, and lower end 122 of scoop directed downwardly toward appendages 42 and 43. The attachment structure used to removably secure scoop 22 to body 30 secures scoop 22 in this described position.

Front face 35 is preferably contoured to accept the contour of rear end 124 of scoop 22. In the immediately embodiment, front face 35 is generally concave, and rear end 124 of scoop 22 is correspondingly generally convex, and this arrangement can be reversed, if desired. Those having regard for the art will readily appreciate that other complementing contours can be used between front face 35 and rear end 124 of scoop 22.

In the preferred embodiment disclosed herein, scoop 22 is removably couplable to body 30 with a scoop hanger 130 attached to body 30, which receives thereon/thereagainst an abutment 131 carried by scoop 22 facilitating a hanging or suspending attachment of scoop 22 to body 30. Scoop hanger 130 is an upwardly-directed hook or hook-like feature, which is positioned adjacent upper extremity 31 between upper extremity 31 and lower extremity 32 at a generally intermediate location between sides 33 and 34. Scoop hanger 130 projects forwardly of front face 35.

There is an opening 132 through rear end 124 of scoop 22 adjacent open upper end 121 between open upper end 121 and lower end 122 at a generally intermediate position between sides 125 and 126, which is sized to receive scoop hanger 130 therethrough. Abutment 131 is an upper edge of opening 132, which rests against scoop hanger 131 hanging/suspending scoop 22 from scoop hanger 130 and, thus, detachably/removably attaching scoop 22 to body 30 as seen in FIGS. 1-7, 10, and 11.

Abutment 131 need not be part of an opening, but rather can be arranged or attached to scoop 22 in other ways as may be desired. For example, abutment 131 can form part of an element, bracket, or other attachment to scoop 22. Although scoop hanger 130 is carried by body 30 and abutment 131 is carried by scoop 22, this arrangement can be reversed, if desired.

Scoop hook 130 and abutment 131 represent a preferred engagement structure, namely, an engagement element and detachably engagable complemental engagement element, for facilitating a detachably engagement of scoop 20 to body 30. Although one scoop hanger 130 and one corresponding abutment 131 is disclosed in a preferred embodiment of an engagement structure for detachably engaging scoop 22 to body 30, more can be used, if desired. In the preferred embodiment disclosed herein, scoop 22 is hung from body 30, which allows it to be readily taken up from body 30 and reinstalled onto body 30 by presenting rear end 124 of scoop 22 onto front face 35 of body 22 and attaching abutment 131 to scoop hanger 130. Nevertheless, those having regard for the art will readily appreciate that other ways of removably or detachably engaging scoop 22 to body 30 can be used without departing from the invention, such as various forms of complementing male and female engagement features, tongue and groove arrangements, a hook and loop fastener, etc. If desired, scoop 22 can be supported in a seat attached to body 30, in which lower end 122 of scoop 22 is placed in the seat so as to rest therein.

Drain 23 is associated with scoop 22 and conducts liquid, such as bathwater and rinse water, to drain therefrom. Preferably, drain 23 consists of a plurality of drain openings or holes 140 through scoop 22 by which liquid is able to pass from scoop 22 and from bath accessories in scoop 22. Drain openings 140 extend through continuous sidewall 120, and also through lower end 122, if desired. Preferably, twenty or thirty drainage openings 140 are used and together function as drain 23, although less or more can be employed, if desired. Drain openings 140 can be substantially equal in size, or differently sized. Drain openings 140 can each by any size by which liquid can pass therethrough from scoop 22.

A plurality of drain openings 140 are disclosed as a preferred drain 23. Other drain forms can be used, if desired. As a matter of example, drain 23 can consist of single drainage opening (such as one of drain openings 140), if desired, or at least one drainage opening 140 (such as at least one of drainage openings 140), by which liquid is drawn off from scoop 22. Drain 23 may also consist of a pipe or channel associated with scoop 22 by which liquid is drawn off from scoop 22. Other drain forms by which liquid is drawn off from scoop 22 can be used without departing from the invention. Open upper end 121 is not considered a drain, but is rather the open end of scoop 22 through which bath accessories pass through and into scoop 22 in scooping operations.

In accordance with intended use, device 20 is mounted at an elevated location at or adjacent a bathing area, such as adjacent a bathtub 200 as shown in FIG. 10, or within or adjacent a shower. Looking to FIGS. 10 and 11, device 20 is shown mounted to a wall 201 at an elevated location relative to bathtub 200 (shown only in FIG. 10), in which head 101 projects upwardly, back face 36 faces wall 201 and the front of device 20, including scoop 22 and front face 104 of head 101, presents outwardly. In the immediate embodiment, conventional suction cups 208 are used to attach device 20 to wall 21. Suction cups 208 are mounted to back face 36 of body 30 in a well-known and conventional manner, and are directed against wall 201 providing the suction cup attachment. Preferably, device 20 incorporates four suction cups arranged in a generally square pattern at the corners of body 30. Although device 20 preferably incorporates four suction cups 208, less or more can be used, if desired. Also, if a plurality of suction cups are used, they may be arranged in any desired pattern. Device 20 can be attached to wall 201 in other ways, such as with one or more hangers, screws, hook-and-loop fastener, adhesive, one or more double-sided adhesive pads, etc.

Figure 7:
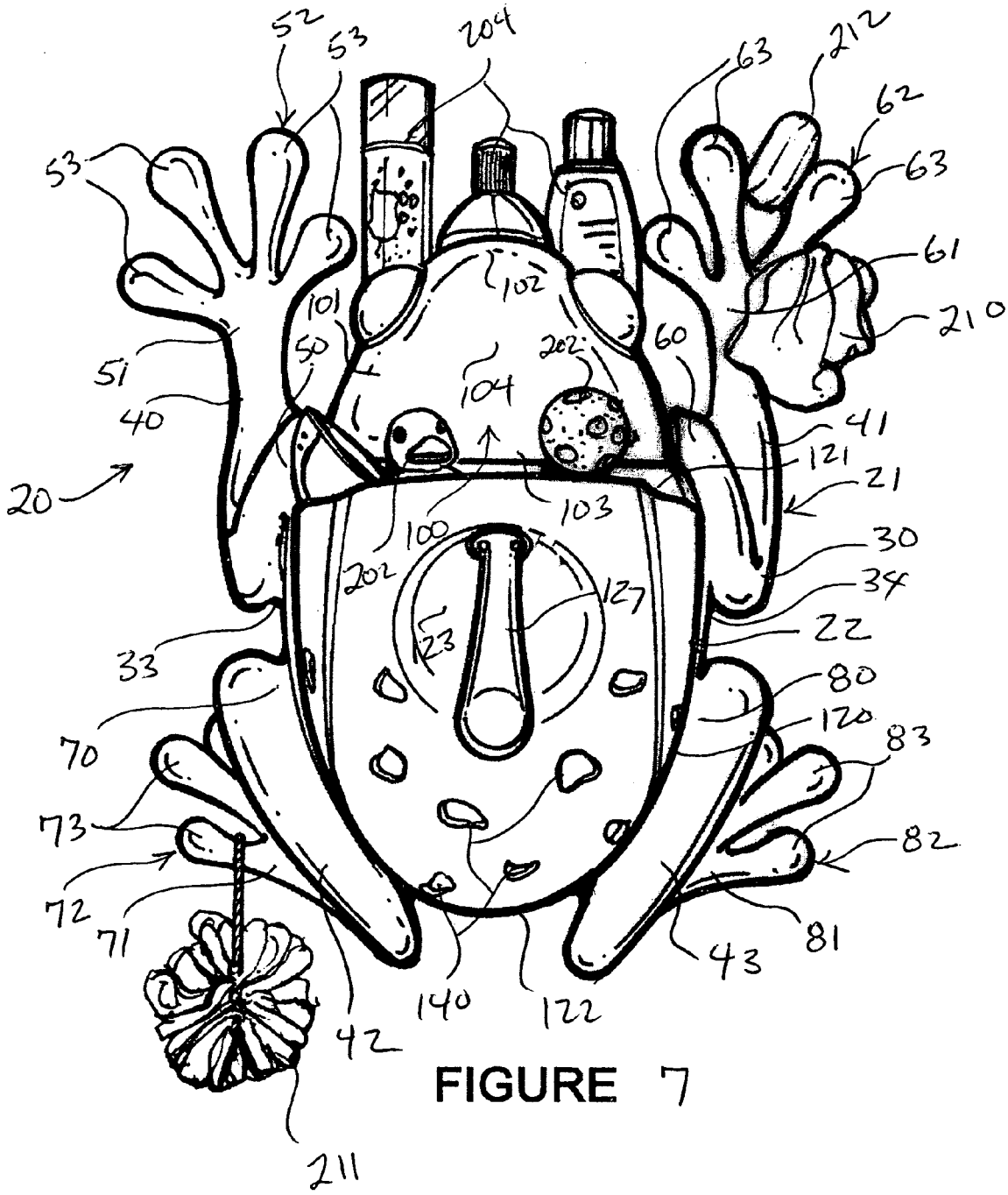
FIG. 7 is a front plan view of the device of FIG. 1 shown as it would appear holding bath accessories.
Figure 11:
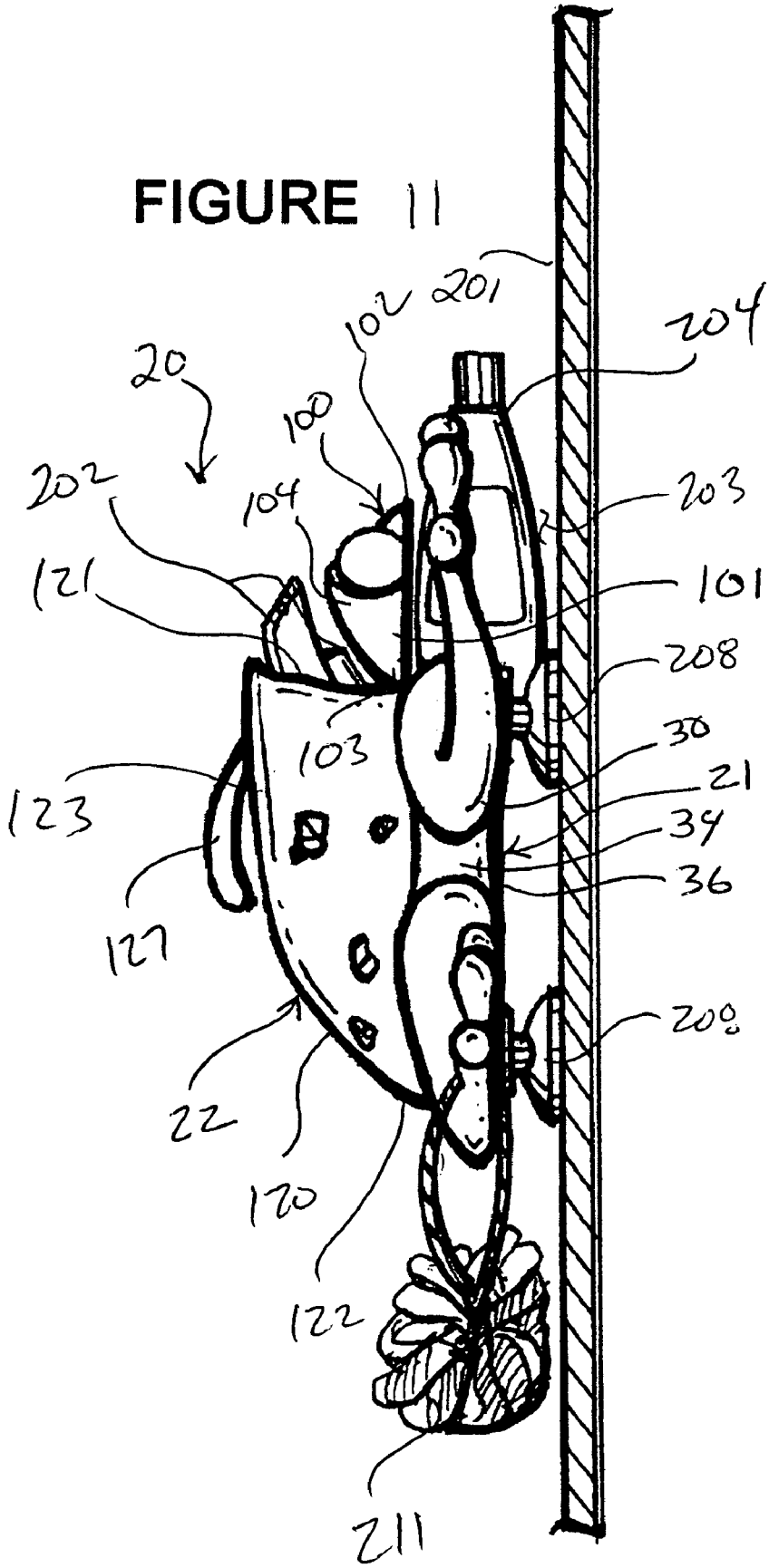
FIG. 11 is a side elevational view of the device of FIG. 1 shown as it would appear secured to a wall.

Properly mounted as herein described, and as depicted generally in FIG. 10, scoop 22 is available to be used and it can be seen in FIGS. 10 and 11 that head set 100 is arranged and positioned relative to body 30 so that shelf 106 is positioned between wall 201 and back face 105 of head 101, which is spaced away from wall 201. Moreover, head 101 is spaced from, and substantially parallel to, wall 201, in which a space 203 exists between back face 105 of head 101 and wall 201 above shelf 106. Bath accessories, such as bottles of shampoo, bath wash, hair conditioner, and the like, can be maneuvered into space 203 and placed onto shelf 106 rearwardly of or otherwise behind head 101 for convenient storage of such items. FIG. 7 illustrates bath accessories, namely, bottles 204 of shampoo and/or condition and/or bath wash or the like, as they would appear positioned on shelf 106 (not shown in FIG. 7) behind head 101 allowing bath accessories Drainage holes 107 (shown in FIG. 5) allow any water to drain away from shelf 106 and from device 20.

As seen in FIGS. 10 and 11, scoop 22 is available to be used can be easily taken up by hand with the use of handle 127 and detached from base 21 mounted to wall 201, and used to scoop bath accessories, such as bath toys 202 and the like, from bathtub 200 as seen in FIG. 12, in which drain 23 functions to drain bath water from scoop 22. After scooping up bath accessories 202, scoop 22 can be reattached to base 21 for convenient storage of bath accessories 202 it contains and for allowing them to dry. The plurality of drain openings 140 that constitute drain 23 in the preferred embodiment herein disclosed is important because they permit air to circulate through scoop 22 for causing the bath accessories therein to dry efficiently and quickly. Prior to reattaching scoop 22 to base 21 as seen in FIG. 13, clean water, such as from a faucet 205 of bathtub 200, can be poured into scoop 22 through open upper end 121 and over bath accessories 202 therein for rinsing them prior to storage and drying.

Considering FIG. 10, wash cloths and bath poufs and like bath accessories can be conveniently hung from appendages 40-43 for hang drying after use and convenient storage, in which each of appendages 40-43, including each of the pegs associated therewith, function as hangers for such items and similar items. As a matter of example, FIG. 7 illustrates a washcloth 210 shown as it would appear hung over one of pegs 63 of appendage 41, and a bath pouf 211 shown as it would appear hung over one of pegs 73 of appendage 42. Appendages 40 and 43, including their respective pegs, are similarly used. Furthermore, FIG. 7 illustrates a bar of soap 212 as it would wedged between, and grippingly held by, a pair of opposing ones of pegs 63 of appendage 41, in which the pair of opposing ones of pegs 63, which function as a clamp holding bar of soap 212 in place. Any pair of opposing ones of the pegs of each of appendages 40-43 can be used in this manner for clamping/gripping and holding selected bath accessories.

It is to be understood that any number of pegs may be used in conjunction with each of appendages 40-43 depending on specific needs and requirements. Also, appendages 40-43 can each be fashioned with no pegs, if desired, in which each appendage would function as a simple hanger for wash cloths, bath poufs, and the like. Nevertheless, is it preferred that one or more of appendages 40-43 be fashioned with a plurality of pegs for providing a clamp, as herein previously described, for bars of soap and other selected bath accessories.

As can be seen in FIGS. 1-7, 10, and 11, device 20 presents the appearance of an animal when scoop 22 is attached to base 21. In this specific example, the animal presented is a frog, in which appendages 40 and 41 present the appearance of the arms and hands of the frog, appendages 42 and 43 present the appearance of the legs and feet of the frog, head 101 presents the appearance of the head of the frog, and scoop 22 presents the appearance of the back and main body of the frog. In this specific embodiment, the pegs of the hands and feet of appendages 40-43 constitute the fingers and toes of the frog, which, as previously discussed, are used to hang wash cloths and bath poufs and the like for drying and storage. The appearance of device 20 as a frog is, in accordance with the principle of the invention, highly desirable because it promotes interest in device 20 by young children and encourages use of device 20 by young children at the completion of bathing for collecting and storing their bath toys.

Although scoop 22 presents the appearance of the back and main body of the frog, it can be designed and arranged to represent one or more additional parts of the frog, or a different part of the frog. Also, although appendages 40-43 are carried by body 30 and considered part of base 21, one or more or all of appendages 40-43 can be attached to scoop 22, if desired.

In accordance with the principle of the invention, device 20 can be made to present the appearance of other animal forms when scoop 22 is attached to base 21, including a selected mammal, bird, reptile, fish, insect, etc. Depending on the type of animal device 20 presents in appearance when scoop 22 is attached to base 21, device can be fashioned with any required number of appendages, including any required number of corresponding pegs (i.e., fingers and/or toes) if applicable which, as disclosed herein, are to be used as hangers for wash cloths, bath poufs, and the like. Furthermore, device 20 can be made to present the appearance of other things or objects, such as a plant, a caricature of a human subject, such as a celebrity, a sports figure, a movie star, etc., a cartoon or animated character or the like, a balloon, a collection or arrangement of balloons, designed to promote interest in device 20 by children and for encouraging use of device 20. Also, scoop 22 can form any part of the object or thing that device 20 represents when scoop 22 is attached to base 21.

The present specification discloses a novel and useful bath accessory collection and storage device 20. Device 20 is easy to constructed, easy and convenient to use, and can be mounted at any height for providing convenient access thereto. Base 21 functions as caddy for holding and supporting soap, shampoo, conditioner, wash cloths, bath poufs, and other selected bath accessories, and scoop 22 is useful for collecting bath accessories, such as bath toys and the like as herein described, and also storing scooped-up bath accessories by reattaching scoop 22 to base 21. More particularly, appendages 40-43, including each of the pegs associated therewith, each function as convenient hangers for wash cloths and bath poufs and towels the like, and scoop 22 provides a quick and easy way to pick up, rinse, and store bath toys and other selected bath accessories.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A bath accessory collection, holder, and storage device comprising:

a base;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

appendages carried by at least one of the base and the scoop;

the device presenting the appearance of an animal having appendages when the scoop is attached to the base; and a handle attached to the scoop.

2. The bath accessory collection, holder, and storage device of claim 1, further comprising a shelf, carried by the base, for receiving and supporting bath accessories thereon.

3. The bath accessory collection, holder, and storage device of claim 1, further comprising:

a engagement element carried by one of the base and the scoop; and a detachably engagable complemental engagement element carried by the other of the base and the scoop.

4. The bath accessory collection, holder, and storage device of claim 3, wherein the engagement element comprises one of a scoop hanger and an abutment, and the complemental engagement feature comprises the other of the scoop hanger and the abutment.

5. A bath accessory collection, holder, and storage device comprising:

a base;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

appendages carried by at least one of the base and the scoop;

the device presenting the appearance of an animal having appendages when the scoop is attached to the base; and a hanger, carried by one of the appendages, for suspending at least one bath accessory thereon.

6. A bath accessory collection, holder, and storage device comprising:

a base;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

appendages carried by at least one of the base and the scoop;

the device presenting the appearance of an animal having appendages when the scoop is attached to the base; and a clamp, carried by one of the appendages, for grippingly holding at least one bath accessory.

7. A bath accessory collection, holder, and storage device comprising:

a base;

a scoop, removably couplable to the base, having a drain for draining liquid therefrom;

appendages carried by at least one of the base and the scoop;

the device presenting the appearance of an animal having appendages when the scoop is attached to the base; and means for detachably securing the base to a surface.

8. The bath accessory collection, holder, and storage device of claim 7, wherein the means for detachably securing the base to a surface comprises at least one suction cup.

9. A bath accessory collection, holder, and storage device comprising:

a base having appendages and a head;

the head having a shelf for receiving and supporting bath accessories thereon;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

the appendages, the head, and the scoop presenting the appearance of an animal when the scoop is attached to the base;

a handle attached to the scoop.

10. The bath accessory collection, holder, and storage device of claim 9, further comprising:

a engagement element carried by one of the base and the scoop; and a detachably engagable complemental engagement element carried by the other of the base and the scoop.

11. The bath accessory collection, holder, and storage device of claim 10, wherein the engagement element comprises one of a scoop hanger and an abutment, and the complemental engagement feature comprises the other of the scoop hanger and the abutment.

12. A bath accessory collection, holder, and storage device comprising:

a base having appendages and a head;

the head having a shelf for receiving and supporting bath accessories thereon;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

the appendages, the head, and the scoop presenting the appearance of an animal when the scoop is attached to the base; and a hanger, carried by one of the appendages, for suspending at least one bath accessory thereon.

13. A bath accessory collection, holder, and storage device comprising:

a base having appendages and a head;

the head having a shelf for receiving and supporting bath accessories thereon;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

the appendages, the head, and the scoop presenting the appearance of an animal when the scoop is attached to the base; and a clamp, carried by one of the appendages, for grippingly holding at least one bath accessory.

14. A bath accessory collection, holder, and storage device comprising:

a base having appendages and a head;

the head having a shelf for receiving and supporting bath accessories thereon;

a scoop, removably couplable to the base, having a drain for draining liquid therefrom;

the appendages, the head, and the scoop presenting the appearance of an animal when the scoop is attached to the base; and means for detachably securing the base to a surface.

15. The bath accessory collection, holder, and storage device of claim 14, wherein the means for detachably securing the base to a surface comprises at least one suction cup.

16. A bath accessory collection, holder, and storage device comprising:

a base having appendages;

a head, having a shelf for receiving and supporting bath accessories, removably couplable to the base;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

the appendages, the head, and the scoop presenting the appearance of an animal when the scoop and the head are attached to the base; and a handle attached to the scoop.

17. The bath accessory collection, holder, and storage device of claim 16, further comprising:

a engagement element carried by one of the base and the scoop; and a detachably engagable complemental engagement element carried by the other of the base and the scoop.

18. The bath accessory collection, holder, and storage device of claim 17, wherein the engagement element comprises one of a scoop hanger and an abutment, and the complemental engagement feature comprises the other of the scoop hanger and the abutment.

19. A bath accessory collection, holder, and storage device comprising:

a base having appendages;

a head, having a shelf for receiving and supporting bath accessories, removably couplable to the base;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

the appendages, the head, and the scoop presenting the appearance of an animal when the scoop and the head are attached to the base; and a hanger, carried by one of the appendages, for suspending at least one bath accessory thereon.

20. A bath accessory collection, holder, and storage device comprising:

a base having appendages;

a head, having a shelf for receiving and supporting bath accessories, removably couplable to the base;

a scoop, removably couplable to the base, having a drain for draining liquid therefrom;

the scoop including an continuous sidewall having an open upper end and an opposed lower end;

the drain comprising a plurality of openings formed through the continuous sidewall between the open upper end and the opposed lower end;

the appendages, the head, and the scoop presenting the appearance of an animal when the scoop and the head are attached to the base; and a clamp, carried by one of the appendages, for grippingly holding at least one bath accessory.

21. A bath accessory collection, holder, and storage device comprising:

a base having appendages;

a head, having a shelf for receiving and supporting bath accessories, removably couplable to the base;

a scoop, removably couplable to the base, having a drain for draining liquid therefrom;

the appendages, the head, and the scoop presenting the appearance of an animal when the scoop and the head are attached to the base; and means for detachably securing the base to a surface.

22. The bath accessory collection, holder, and storage device of claim 21, wherein the means for detachably securing the base to a surface comprises at least one suction cup.

* * * * *